US005301621A

United States Patent [19]

Vassiliou et al.

[11] Patent Number: 5,301,621

[45] Date of Patent: Apr. 12, 1994

[54] SLAG VISCOSITY DETECTION THROUGH IMAGE ANALYSIS OF DRIPPING SLAG WITHIN ROTARY INCINERATION KILNS

[75] Inventors: Eustathios Vassiliou, Newark, Del.; Joseph F. Giunto, Pitman; Walter R. Schaefer, Cherry Hill, both of N.J.; Bruno R. Kuhn, Nassau Bay, Tex.

[73] Assignee: Rollins Environmental Services, Inc., Wilmington, Del.

[21] Appl. No.: 62,790

[22] Filed: May 17, 1993

[51] Int. Cl.[5] ..... F23G 5/00

[52] U.S. Cl. ..... 110/346; 110/185; 110/186; 110/246

[58] Field of Search ..... 110/246, 346, 185, 186, 110/165 R; 73/861.32, 861.35, 861.41; 432/103

[56] References Cited

U.S. PATENT DOCUMENTS

| | | | |
|---|---|---|---|
| 4,361,032 | 11/1982 | Lessnig et al. | 73/64.4 |
| 4,432,286 | 2/1984 | Witte | 110/193 |
| 4,646,562 | 3/1987 | Cronan | 73/64.4 |
| 4,942,760 | 7/1990 | Almeida | 73/64.4 |
| 5,228,398 | 7/1993 | Byerly et al. | 110/246 |

FOREIGN PATENT DOCUMENTS

| | | | |
|---|---|---|---|
| 57-84917 | 5/1982 | Japan | 110/185 |
| 59-1919 | 1/1984 | Japan | 110/186 |
| 2-187510 | 7/1990 | Japan | 110/185 |

*Primary Examiner*—Edward G. Favors
*Attorney, Agent, or Firm*—E. Vassiliou

[57] ABSTRACT

Methods and devices for controlling rotary incineration kilns by determining and controlling the viscosity of slag which is formed in such kilns. These methods and devices are based on measuring one or more properties or parameters of drippings of the slag falling from the ceiling of the kiln, as the kiln rotates. The parameters are size of drippings, shape of drippings, aspect ratio of drippings, and number of drippings.

25 Claims, 4 Drawing Sheets

SLAG VISCOSITY DETECTION THROUGH IMAGE ANALYSIS OF DRIPPING SLAG WITHIN ROTARY INCINERATION KILNS

FIELD OF THE INVENTION

This invention relates to methods and devices for controlling rotary incinerating kilns for waste materials. More particularly it pertains to methods and devices for determining and controlling the viscosity of slag which is formed in such rotary incinerating kilns.

BACKGROUND OF THE INVENTION

Incinerator rotary kilns have an outside metallic shell, usually steel, the inside of which is fully covered by a thick ceramic wall, usually in the form of fire bricks having a total thickness exceeding in many cases 25 cm. These kilns usually operate at a exit gas temperature in the range of about 1,800° to 2,400° F. The ceramic walls, however, are very vulnerable to erosion and corrosion, due to the hostile conditions created by the nature of incinerated materials and high temperatures, especially, if alkali metals are present. If the viscosity of slag in the kiln is adequately high, it may form a rather thick viscous coating on the ceramic and thus protect it from the hostile environment. However, when the viscosity of the slag is very low, the slag contributes to the erosion and corrosion of the ceramic, both chemically because it serves as a solvent and mechanically, as it allows foreign big pieces of abrasive material to act against the ceramic walls. If the slag is viscous to the point of becoming substantially solid, or if it has never been formed as a liquid, it becomes ineffective in promoting combustion of organic matter, and also in capturing toxic heavy metals. Therefore, it is imperative that the viscosity of the slag is very carefully monitored and controlled within a range of values. Thus, one of the objects of this invention is to determine and correct the viscosity of the slag in rotary incinerating kilns.

Video cameras and other observation means have been used to inspect, different aspects of incineration chambers and other combustion devices. However, none of them deals with determining and controlling the viscosity of the slag in rotary incineration kilns by determining at least one property of slag drippings falling from the ceiling of the kiln, the properties including size of drippings, shape of drippings, aspect ratio of drippings, and number of drippings.

Our co-pending application Ser. No. 07/908,056, filed Jul. 6, 1992 (Byerly et al.), U.S. Pat. No. 5,228,398 which is incorporated herein by reference, describes methods and devices for controlling rotary incineration kilns by determining the position of the kiln outlet at which the slag is exiting.

Japanese Patent 57-84917, issued May 27, 1982 (Horie), describe a system, wherein an industrial TV camera is used to watch the terminating point of combustion of a garbage incinerator. The camera detects one by one the luminosities of combustion along a line intersecting at right angles with the transfer direction of the garbage. The camera, also detects the length of a portion on the line having a luminosity exceeding a predetermined level and compares it to a predetermined value.

Japanese Patent 59-1919, issued Jan 7, 1984 (Kojima), discloses a method, the purpose of which is to improve the discriminating accuracy of a combustion condition. This method is based on an image projected on a monitor, so that it automatically discriminates a combustion condition in an incinerator, and controls the combustion condition in the incinerator.

Japanese Patent 2-187510, issued Jul. 23, 1990 (Yoshii) discloses a method, the purpose of which is to make the incineration operation automatic, and make it possible to hold the point of complete burning of the refuge stable, by detecting optically the point of burning the dust in a combustion chamber and calculating the deviation from a control target and speed of movement of the result of detection, and then applying fuzzy inference to control the operation cycle or rotational speed of the combustion chamber.

Japanese Patent discloses a process, the purpose of which is to measure the temperature, the outflow speed, and an amount of outflow slug, and to perform rapid and proper processing without a time lag, so that discharge of slug is stabilized by a method wherein a slug outflow state is photographed by using a color TV and picture processing is applied thereon. In more detail, an industrial color TV is mounted in the vicinity of a slug tap, and in a data processing device, an input from the industrial color TV is always measured as a light three-original color output level through a filter in a four-division picture processing range, and a real time of temperature is measured, by means of a color tone. Regarding a slag outflow speed, the upper and lower parts of a four division picture are measured at intervals of 5 seconds, displacement in the slag flow is determined, and the outflow speed is also determined. Further, regarding an outflow slag amount, a change with time of the area of molten slag present in the four-division picture is trended at intervals of 5 seconds to determine a deviation in a steady value. By regulating an amount of enriched oxygen, an auxiliary fuel amount, and/or a sludge feed amount, molten slag is discharged in a stabilized state.

U.S. Pat. No. 4,361,032 (Lessnig et al.) discloses an apparatus for automatically determining the surface tension by the stalagmometer principle using a pipette containing a test volume, having a drop face at its lower end and is provided with three light barriers. The three light barriers are connected to an evaluation circuit which counts the number of whole drops and also determines the fractions of whole drops pertaining to the test volume.

U.S. Pat. No. 4,432,286 (Witte) discloses a pinhole camera system utilizing a sealed optical purge assembly which provides optical access into a coal combustor or other energy conversion reactors. The camera system basically consists of a focused-purge pinhole optical port assembly, a conventional TV vidicon receiver, an external, variable density light filter which is coupled electronically to the vidicon automatic gain control (agc). The key component of this system is the focused-purge pinhole optical port assembly which utilizes a purging inert gas to keep debris from entering the port and a lens arrangement which transfers the pinhole to the outside of the port assembly. One additional feature of the port assembly is that it is not flush with the interior of the combustor.

U.S. Pat. No. 4,646,562 (Cronan) discloses a method and apparatus for continuous monitoring of the relative dynamic surface activity of a liquid in which the surface activity can be rapidly changing is disclosed. The liquid is flowed through an orifice at a constant volume flow rate to produce liquid drops. The time intervals between successive drops from the orifice are measured.

Variations in the time intervals of pairs of two successive drops provide an indication of the volume of the second drop of each pair and thus provide an indication of the relative dynamic surface activity of the second drop. The measured time intervals are converted into electrical signals which are representative of the respective measured time intervals. The method and apparatus can be applied to liquid chromatography separations to continuously and quickly provide information about surface active components of the liquid and is especially applicable when only a small volume of the sample liquid is available. The method and apparatus can also be applied to industrial process monitoring and to use as a general laboratory instrument or method.

U.S. Pat. No. 4,942,760 (Almeida) discloses an apparatus to measure interfacial tension of fluids in equilibrium and, more particularly, a liquid in equilibrium with a gaseous phase thereof using a pendant drop method, at superatmospheric pressure and elevated temperature conditions. The apparatus includes a visual cell having an interchangeable, multiple capillary injection system, a double-piston pump which permits the drop's injection into the cell without disturbing the experimental conditions, and an optical system comprising a photographic camera, a telemicroscope, and a lighting system.

SUMMARY OF THE INVENTION

As aforementioned, this invention relates to methods and devices for controlling rotary incinerating kilns for waste materials. More particularly it pertains to an incinerating kiln device capable of controlling the viscosity of molten slag contained within the kiln, the device comprising a rotary kiln having a substantially cylindrical shape, an inside wall, an inlet end, an outlet end opposite the inlet end, a bottom side, and a ceiling side, opposite the bottom side, the ceiling side and the bottom side being part of the inside wall, the rotary kiln being adaptable to contain a quantity of molten slag, in a manner that when the kiln rotates, at least a portion of the molten slag temporarily adheres to the inside wall and it is transferred from the bottom side of the kiln to the vicinity of the ceiling side, wherefrom it may fall back to the bottom side, at least partially, in the form of drippings; and detection means at one end of the kiln for determining at least one property of the drippings selected from the group consisting of size of drippings, shape of drippings, aspect ratio of drippings, and number of drippings.

Preferably, the kiln has an inclination in a manner that the inlet end is at a higher level than the outlet end, so that slag has also a tendency to move in a direction from the inlet end to the outlet end, where it may be discharged.

It is preferred that the device further comprises means for processing data received from the detection means, thereby correlating said data with at least one slag parameter selected from the group consisting of molten slag-viscosity and molten slag-quantity.

The device may also comprise means for changing the slag viscosity in a manner to attain a value within desired limits, if the slag viscosity moves outside said desired limits.

The slag viscosity changing means may be operated manually, semi-automatically, or fully automatically, and they may comprise bins for containing additives and for feeding additives to the kiln, and/or means for changing the quantity of the molten slag in a manner to attain a value within desired limits, if the quantity of the molten slag moves outside said desired limits. The slag quantity changing means may also be operated manually, semi-automatically, or fully automatically.

It is preferable that the device comprises means for monitoring the temperature of the slag at different positions on the inside wall of the kiln, and that it further comprises means for processing data received from the detection means, and the temperature monitoring means, thereby correlating said data with at least one slag parameter selected from the group consisting of molten slag viscosity and molten slag quantity.

The present invention, also pertains to methods for controlling incinerating rotary kilns of the type described above, comprising the steps of:

a) feeding waste to the kiln, the kiln having a substantially cylindrical shape, an inside wall, a bottom side, and a ceiling side, opposite the bottom side, the ceiling side and the bottom side being part of the inside wall, the rotary kiln being adaptable to contain a quantity of molten slag, in a manner that when the kiln rotates, at least a portion of the molten slag temporarily adheres to the inside wall and it is transferred from the bottom side of the kiln to the vicinity of the ceiling side, wherefrom it may fall back to the bottom side, at least partially, in the form of drippings; and (b) detecting and determining at least one property of the drippings selected from the group consisting of size of drippings, shape of drippings, aspect ratio of drippings, and number of drippings.

BRIEF DESCRIPTION OF THE DRAWING

The reader's understanding of practical implementation of preferred embodiments of this invention will be enhanced by reference to the following description taken in conjunction with the drawing figures, wherein.

DETAILED DESCRIPTION OF THE INVENTION

As previously mentioned, this invention relates to methods and devices for controlling rotary incinerating kilns for waste materials. More particularly, it pertains to methods and devices for controlling the viscosity of slag contained in a rotary incinerating kiln by detecting at least one property of slag drippings falling from the ceiling of the kiln, as the kiln rotates. These properties include size of drippings, shape of drippings, aspect ratio of drippings, and number of drippings. If the viscosity deviates from a predetermined range of values, appropriate additives are supplied to the slag or actions taken for bringing the viscosity back to within the range of the predetermined values. This invention also pertains to combinations of other important parameters which are vital for the efficient operation of rotary incineration kilns, as discussed in detail hereinwith.

Figure 1:
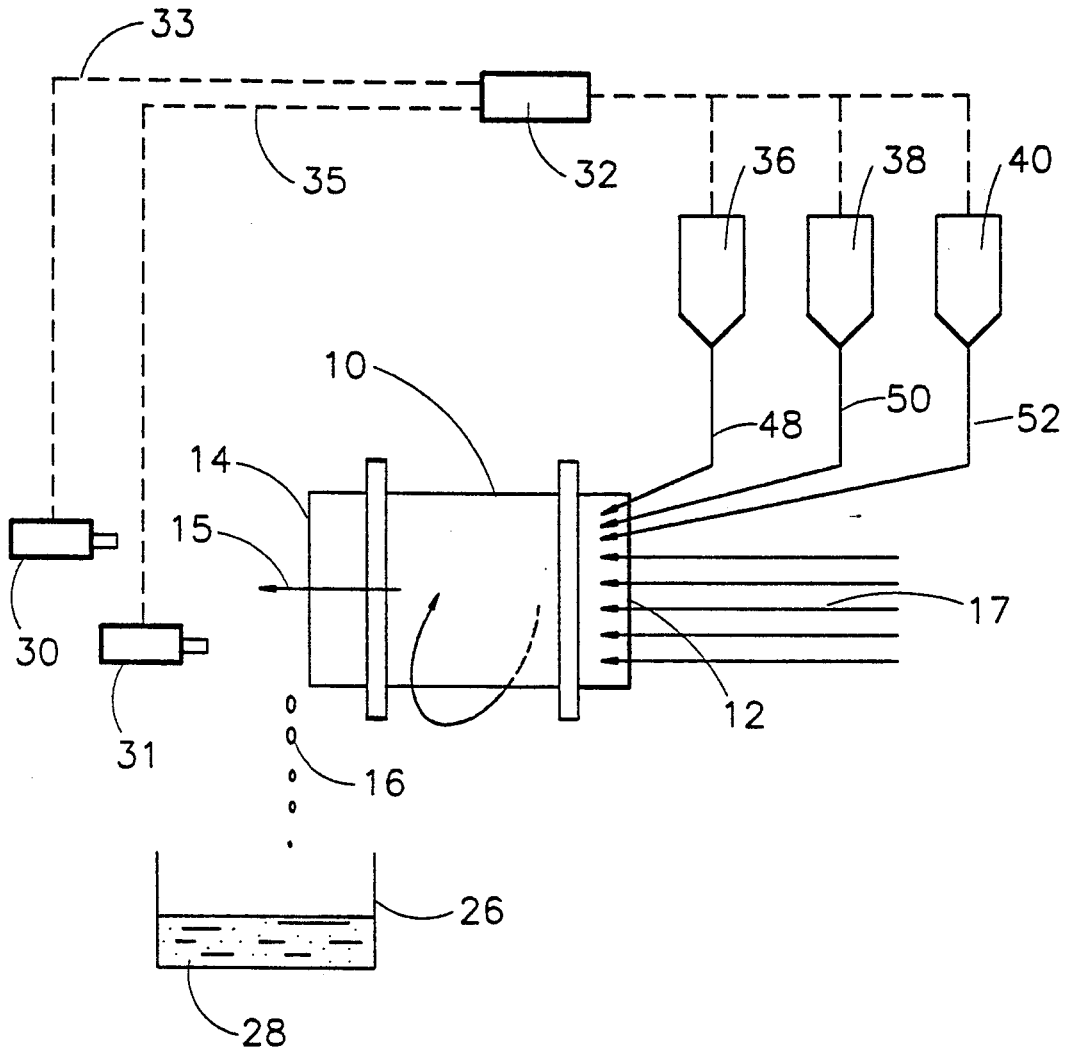
FIG. 1 shows schematically a kiln device provided with waste feed lines, fuel lines, and additive lines, according to one embodiment of the present invention.

Referring now to FIG. 1 there is schematically depicted a rotary incineration kiln 10, well known to the art, according to a preferred embodiment of this invention. The kiln 10 has an inlet end 12 for waste material feeding, and an outlet end 14, which is an exit for the off-gases denoted by arrow 15 and for slag 16. The slag 16 is produced by the waste, as well as by different additives fed usually through the inlet end of the kiln. The slag may be newly formed in its totality, or it may be recirculated, depending on the desired performance of the kiln. Liquid or gaseous waste materials may be fed through lances (not shown) or other mechanisms, well known to the art of kilns. For purposes of clarity, fuel burners and other conventional devices needed for the operation of the kiln are not shown in detail, since they are well known to the art of incinerating kilns. The arrows 17 represent miscellaneous such feeding lines for solid waste, liquid waste, fuel, air, oxygen, and the like, well known to the art. Bins 36, 38, and 40 may feed additives trough lines 48, 50, and 52, respectively. Of course, more or less bins may be present, or the additives may be introduced into the kiln manually through appropriate ports (not shown), well known to the art. The additives are useful in controlling the viscosity of the slag 16, and to improve the binding of any heavy metals into the slag. The additive in bin 36 may be a viscosity builder, such as silica or alumina for example, while the additive in bin 38 may be a viscosity reducer, such as glass for example. Bin 40, as well as other bins (not shown) may contain other additives, such as slag for recirculation, for example.

Depending on the additive contained in the rest of the bins, such as bin 40, for example, the additive, powdered slag for recirculation for example, may be added in a similar manner. If the recirculating slag has very high viscosity in the molten state at the operating kiln temperatures, preferably in the range of 1,800° to 2,200° F., it may be used as a viscosity builder or thickener. On the other hand, if the recirculating slag has very low viscosity in the molten state in the range of the preferred aforementioned temperatures, it may be used as a viscosity reducer. Thus, depending on the degree of deviation from the acceptable range, a stronger or weaker viscosity modifier (thickener or reducer) or a combination thereof may be introduced to the kiln. The above process is continued to ensure that the viscosity of the slag does not fall outside the predetermined range of desired values, and that an adequate amount of slag is present in the kiln. Time delays have to be built in the system, especially if the system is computerized, so that no overshooting occurs, and therefore feeding of sand (source of silica raising the viscosity) and glass (reducing the viscosity), for example, is only used to correct viscosity deviations of the slag caused by the fed waste and not by the one or the other or both.

The rotary kiln 10 has a substantially cylindrical shape, as aforementioned. The kiln is preferably inclined 1-8%, more preferably 2-6%, and even more preferably 3-4%. During normal operation, the kiln also rotates, preferably at 0.05 to 0.5 rpm, and more preferably at 0.1 to 0.25 rpm, when the diameter of the kiln is 3-5 meters. However, it is also preferred that the kiln has the capability to turn, if desirable for certain functions, at higher speeds in the region of 0.5 to 4 RPM. The higher speeds may be utilized, for example, to remove quickly unwanted local accumulations of slag from the kiln. The combination of the inclination and the rotation forces the slag 16 to exit from the outlet 14 during the operation of the kiln.

It is preferable that slag 16 falls into a tank of water or deslagger 26. The deslagger 26 may have a continuous belt (not shown) at its bottom end 28 for removing the slag. The deslagger 26 serves the purpose of cooling the slag fast and breaking it into smaller and more manageable pieces. In addition, the quenching of the slag in water helps the slag to trap more tightly different heavy metal, which might be present.

Figure 2:
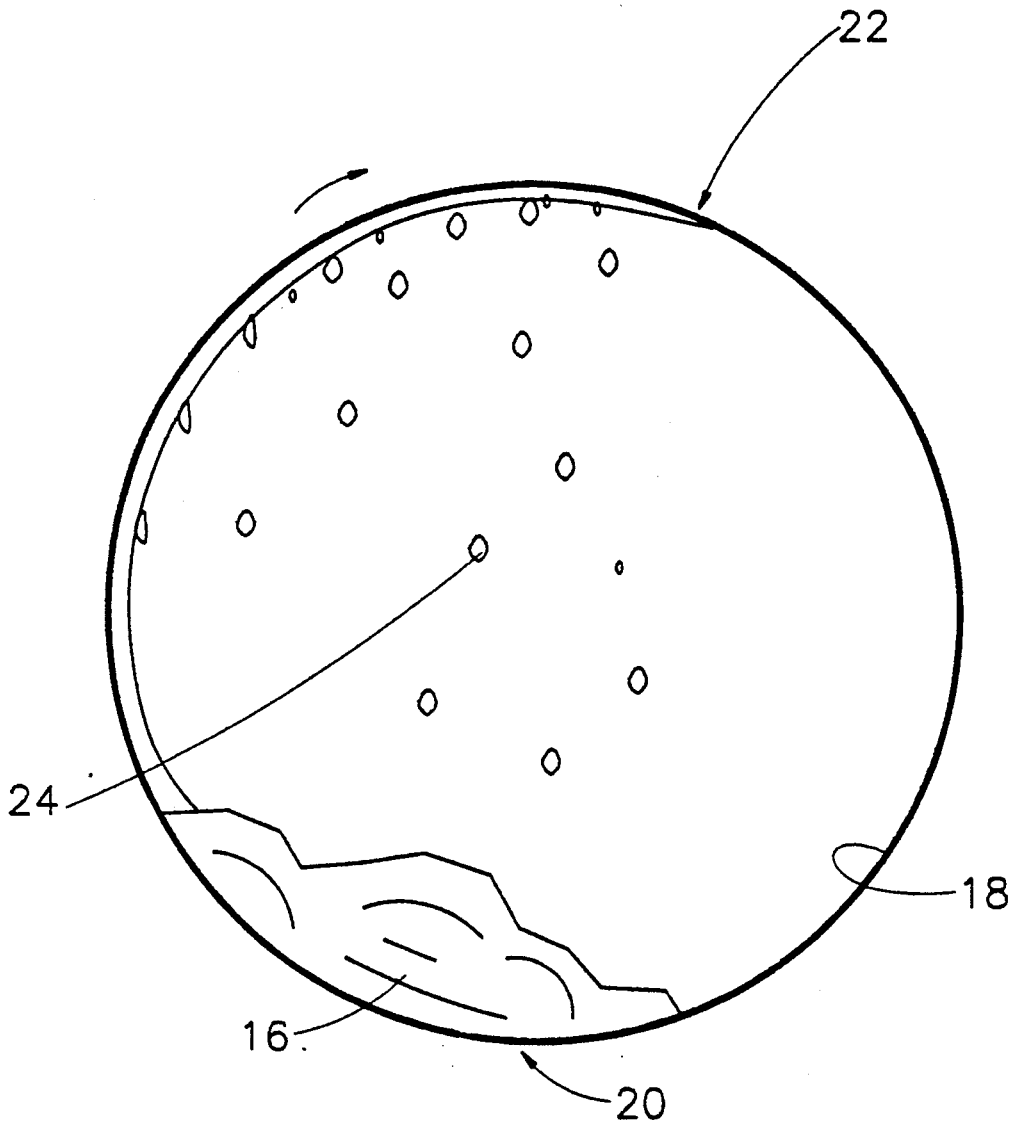
FIG. 2 illustrates schematically a cross-sectional view of the inside of a kiln with molten slag drippings falling from the ceiling of the kiln.

The kiln 10, also has an inside wall 18, better shown in FIG. 2, a bottom side 20, and a ceiling side 22, both of which are part of the inside wall 18. The inside wall 18 of the rotary kiln 10 is usually made of refractory brick, having a thickness of preferably 20-35 cm, built on top of a steel skin, having a thickness of preferably 2-5 cm, for kilns having a diameter of 3-4 m and a length of 8-12 m.

The rotary kiln 10 is adaptable to contain a quantity of molten slag 16, better shown in FIG. 2, in a manner that when the kiln rotates, at least a portion of the molten slag 16 temporarily adheres to the inside wall 18 and it is transferred from the bottom side 20 of the kiln 10 to the vicinity of the ceiling side 22, from where it may fall back to the bottom side 20, at least partially, in the form of drippings 24. In addition, due to the inclination combined with the rotation of the kiln 10, slag 16 falls into the deslagger 26 from the outlet end 14, as better shown in FIG. 1. From the deslagger, the quenched slag may be appropriately packaged and stored for landfilling, or it may be recirculated through bin 40, for example.

At one of the two ends 12 and 14 of the kiln 10, there is positioned detection means 30, shown at the outlet end 14 of kiln 10, in FIG. 1. A primary function of detection means 30 is to have a view of the inside of kiln 10 in a cross-sectional manner, as depicted, for example, in FIG. 2. Images representing this view, taken continuously or intermittently may be sent to computer means 32, through input line 33. The images are in analyzed in computer means 32 with respect to at least one property of drippings 24, which properties include size of drippings, shape of drippings, aspect ratio of drippings, and number of drippings. Preferably, the analysis is conducted with respect to all these properties. Systems performing of inspection and analysis of images are available in the marketplace, and their most common names are Image Analyzers, Image Analysis Systems, and Integrated Vision Systems. Their use so far has been primarily to analyze images under a microscope, pertaining to powder particles, dots of half-tone images, and the like. Example of one such system is the "CUE 2 Image Analysis System", available from Olympus Corporation, Precision Instrument Division, 4 Nevada Drive, Lake Success, NY 11042-1179. Measurements that this instrument may perform are pertaining to properties very well known to the art of Image Analysis and termed as convexity, orientation, specific length, area fraction, feature count, 36 Feret diameters, area, maximum, minimum and average diameters, perimeter, hole area, center of gravity, hole area to object, mean linear intercept, mean chord, closest approach, anisotropy, average radius, area fill, shape factor, and Martin's radii.

Since, as aforementioned, the main end-use of the Image Analysis Systems has been to study microscopic particles, a microscope has accordingly been used in front of the video-camera for, such analyses. However, according to the present invention, a telescope (not shown) should rather be used in front of the detection means 30, in order to view the inside part of the kiln and observe the drippings. Although the different properties of particles, and in this case drippings, may serve an important role in estimating the viscosity and quantity of the slag being present in the kiln, the most important properties for this purpose are:

- the size of the drippings, represented according to the instant invention by the arithmetic average of the cross-sectional area of said drippings, and calculated as the total area of all drippings divided by the number of the drippings;
- the shape of the drippings, represented by the arithmetic average of the shape factors of the drippings, well known to the art of Image Analysis;
- the aspect ratio of the drippings, represented by the arithmetic average of the aspect ratios of said drippings, the aspect ratio defined as the length of an object (dripping in this case) divided by the width of the object; and
- the number of the drippings, represented by the absolute number of drippings within a predetermined period of time.

The image containing the drippings to be analyzed is taken within a predetermined time period, which preferably is short enough to present minimal interference with the properties discussed hereinabove. In case of longer times, respective corrections have to be made to compensate for deviations. For example, if the image is taken in a prolonged time, the shape of the drippings will appear longer than what it really is, and the number of drippings may be larger than what it would have been in the case of a substantially instantaneously taken image. This has a distorting effect in all four properties discussed above, unless a correction is made.

Depending on the particular circumstances, the images may be taken (or "frozen" according to Image Analysis nomenclature) at a particular cross section of the kiln by focusing the telescope (not shown), located in front of the detection means 30, to that particular section. This is particularly important when the temperature in the different sections of the kiln varies considerably, affecting the slag viscosity in these sections accordingly. Telescopes having small focus-depth are more suitable in such occasions. On the other hand, it may be desirable to take the image throughout the length of the kiln. In such an occasion, a telescope with large focus-depth would be more appropriate. In addition, instead of considering just one frozen image at a time, it may be preferable to analyze a sequence of frozen images with regard to the drippings, and take the average of these results for consideration. Weather the results of one or the results of a sequence of frozen images are to be considered, and processed further, this procedure should be repeated at predetermined time intervals ranging from minutes to hours. Since many times the environment in the inside of the kiln is excessively cloudy, if visible-light optical-devices are used for imaging in the detection means, it is preferable to stop the feeding of the smoke producing source for a short period of time, until the environment in the kiln clears up, and the drippings become visible, before taking images of the drippings for analysis. In such occasions, images for analysis may be taken every one half to one hour, for example, so that the kiln does not operate idle for excessive total time. If the waste does not produce a cloudy environment in the kiln, the images may be taken as often as every few seconds.

Although Image Analyzers are normally operating with visible light, miscellaneous other radiation forms may be used according to the present invention, some of which may not be hindered by a cloudy atmosphere in the kiln. These include, but are not limited to, infra-red, radar, sonic, and the like. Of course, appropriate focusing devices to replace the optical telescope, used in the case of Image Analysis based on visible light, have to be employed accordingly.

Example of an infra-red thermal imaging system which may be employed in accordance with the present invention, is "Cyclops T1 35", especially if used in combination with a PC based system under the name "Land Image Processing System", both sold by Land Infrared, Division of Land Instruments International, Inc., 2525 Pearl Back Road, Bristol, PA 19007

Referring back to FIG. 1, there is also preferably provided a thermometer 31, preferably of the Infra-red type, which is preferably capable to read the temperature of the inside wall 18 of the kiln 10 at different positions throughout the length of the kiln. Of course, other types of thermometers may be used. The temperature data from this thermometer are directed to the computer 32 through a second input line 35. The computer means 32 communicates with additive feeding bins 36, 38, and 40 though output line 34 in a manner to individually increase or decrease the feed of each one to kiln 10. It also communicates with one or more of the feeding lines represented by the arrows 17 through additional outputs (not shown in FIG. 1 for purposes of clarity) in order to appropriately regulate their feed rates, if necessary.

Figure 3A:
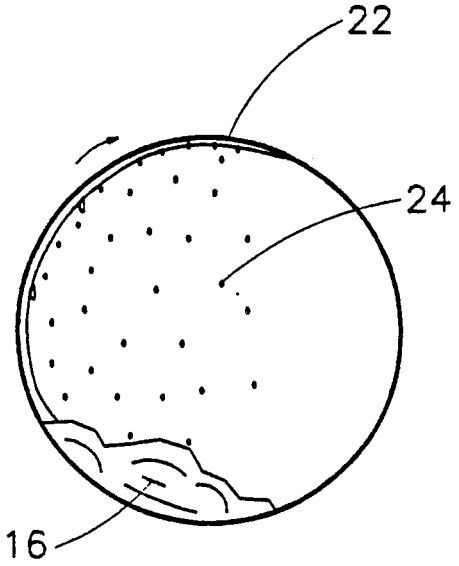
FIGS. 3*a*, 3*b*, 3*c*, and 3*d* illustrate schematically cross sectional views of the inside of the kiln with drippings of increasing slag viscosity.
Figure 3B:
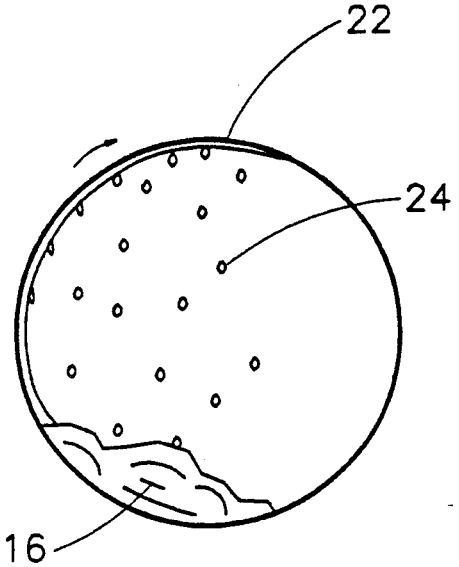
Figure 3C:
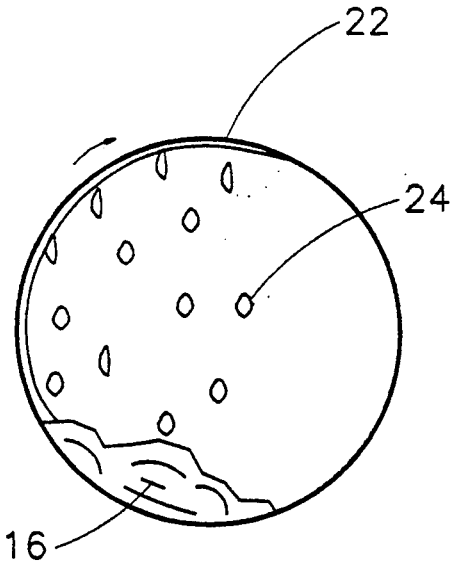
Figure 3D:
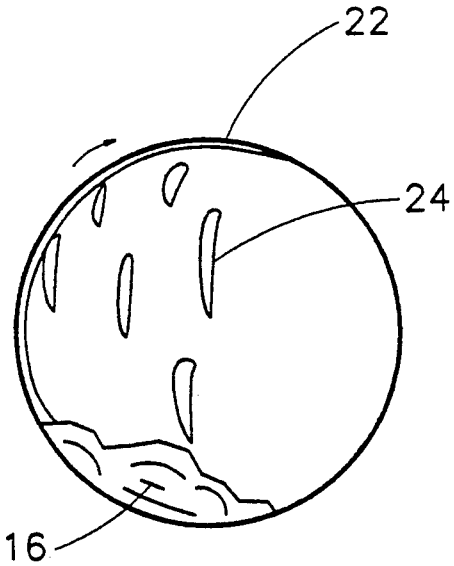
Figure 4A:
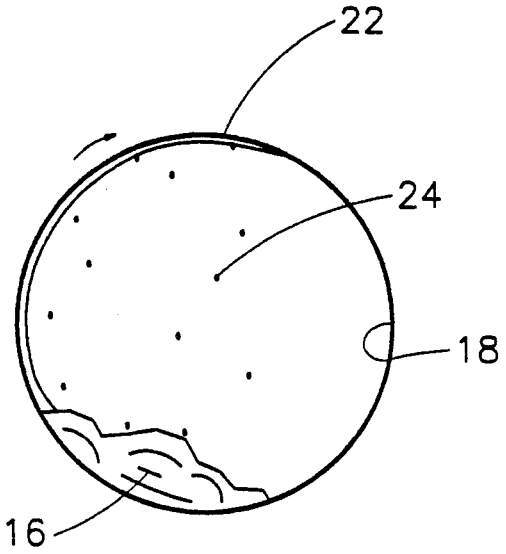
FIG. 4*a* represents schematically a cross sectional view of the inside of a kiln having a low number of small rounded drippings, indicating lack of adequate amount of slag, and that the slag is characterized by low viscosity.
Figure 4B:
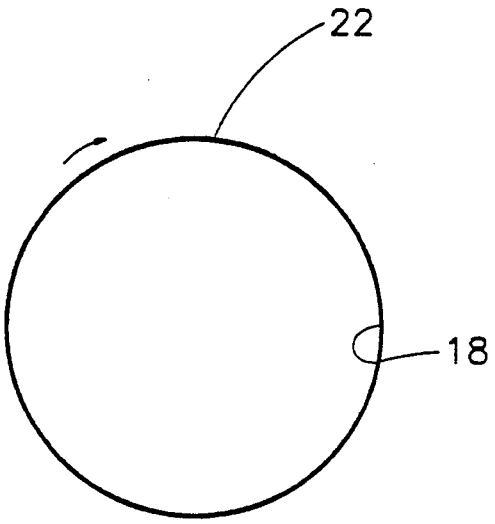
FIG. 4*b* represents schematically a cross sectional view of the inside of a kiln having no dripping, indicating that the kiln contains either solidified slag or no slag.

When the viscosity of the slag is excessively low, threatening the longevity of the kiln refractory, it has the appearance of rain, as it falls from the ceiling 22 of the kiln, and as better shown in FIG. 3*a*. The drippings are many, rather rounded, and small. As the viscosity increases, the number of drippings decreases, the drippings become more oblong, which raises the aspect ratio, and larger, which raises the average cross-sectional area of the drippings, as better illustrated in the sequence of FIGS. 3*b*, 3*c*, and 3*d*. A highly desirable viscosity of the slag is represented by the condition shown in FIG. 3*d*, and the goal in most occasions is for the kiln to operate under parameters providing such a condition. However, this is not practical many times, and broader viscosity limits are usually necessary for optimal overall operation of the kiln. Thus, a slag viscosity ranging from the vicinity of the condition represented by FIG. 3*c* to the vicinity of the condition represented by FIG. 3*d* may be acceptable in many occasions. One important objective of the present invention is to produce a set of numerical values, which represent different viscosity conditions. Thus, the specifications and viscosity limits are left for the operator of the kiln to decide and set. It is important to note that the quantity of the molten slag in the kiln is also very important, since in the absence of molten slag, the combustion of the waste is in most cases incomplete. Thus, although the slag should be as viscous as possible in order to extend the longevity of the refractory in the kiln, the slag viscosity should not be high enough to render the slag solid. Illustrations of such conditions are represented by FIGS. 4*a* and 4*b*. FIG. 4*a* represents a condition, where there is little slag, and it is of low viscosity. FIG. 4*b* represents a condition, where there is either solidified slag or no slag in the kiln. The value of the viscosity in terms of other more commonly used instruments, intended for conventional liquids at relatively low temperatures, is not necessary. The viscosity of the slag according to the present invention may be expressed according to one or more of the four properties or parameters from the group consisting of size of drippings, shape of drippings, aspect ratio of drippings, and number of drippings.

If Dripping Number (A) is defined as the number of slag drippings per 10 square meters of kiln cross-section, Dripping Area (B)is defined as the average cross-sectional area of each dripping in square centimeters, Aspect Ratio (R) is defined as the average ratio of the length (vertical direction) over the width (horizontal direction) of the drippings, then one can define as Viscosity Factor (V) the ratio B/A. Since the viscosity increases with increasing B, and it also increases with decreasing A, the Viscosity Factor V gives a larger spread of values than either A or B, when considered by themselves. The higher the viscosity the higher V is, and the lower the viscosity the lower V is. Also, the higher the viscosity the higher the value of R, although R should be used mostly as an indicator of the degree of polymerization of the slag composition. As the polymerization increases, the slag at a given temperature becomes more stringy, and the value of R increases. The higher the degree of polymerization, the less reactive the slag becomes for substantially similar compositional types. Of course, it should be understood that these relations between the slag viscosity, reactivity, and the properties or parameters of the drippings are not necessarily linear, and they may be valid only within certain limits, which however may be rather broad. Since the slag viscosity is also a function of temperature, wherein as the temperature increases, the viscosity decreases, temperature of the kiln may also be used to influence the viscosity one way or the other. It depends on the characteristics of the kiln, the waste, the additives, the refractory, the preferences of the operator, and the like, on what ranges of the aforementioned dripping parameters to assign and what actions to be taken if the parameters move outside said ranges.

In most cases, acceptable specifications would be:

Viscosity Factor (V): 15–350

Dripping Number (A): 3–15

Dripping Area (B): 250–1,000

In an example of corrective action, if the dripping parameters fall outside the predetermined range of values is given below:

| | |
|---|---|
| A < 3, B < 250 | Indication: Low Slag, Low Viscosity<br>Corrective Action: Add Sand and Slag |
| A > 15, <250 | Indication: Low Viscosity<br>Corrective Action: Add sand |
| A < 3, B > 1,000 | Indication: Low Slag, High Viscosity<br>Corrective Action: Add Glass and Slag |
| A > 15, B > 1,000 | Indication: High Slag, High Viscosity<br>Corrective Action: Add Glass |

In operation, the detection means 30, being in this embodiment an Image Analyzer, is programmed to take and freeze an image of the inside of the kiln 10 at predetermined intervals of time. If the waste is such that it renders the inside of the kiln cloudy, and the detection means use visible light for imaging, the waste feed is stopped until the inside of the kiln becomes clear, before the image is taken. In sequence, the image is analyzed and the values of the different parameters A, B, R, V calculated by the Image Analyzer. The temperature is also taken by the thermometer 31. The data from the Image Analyzer and the thermometer are fed to the computer means 32 through input lines 33 and 35, respectively. Computer means 32 are programmed to process the data received from Image Analyzer and the thermometer, and take corrective action if the values of the temperature and the parameters or properties of the drippings move outside a predetermined range of values. The corrective action may include opening or closing valves (not shown) of the bins 36, 38, and 40 to feed, for example, glass if the viscosity of the slag is too high, feed sand (inexpensive source of silica) if the viscosity of the slag is too low, and feed both or slag if there is lack of slag in the kiln. The corrective action may also include temperature related functions such as increasing the feed rate of high BTU waste, or fuel, if the temperature is too low, and the like. Preferably, the computer is also programmed to estimate expected viscosity changes in relation to temperature changes and integrate them into an overall corrective action by using standard engineering calculations. Since addition of additives, changes of temperature, and changes in slag viscosity are not instantaneous as a result to each other, a time lag is appropriate to be built in the computer means in order to avoid overshooting and large up-and-down variations.

It should be noted that mostly it depends on the individual case for the selection of the values of the parameters and the respective corrective actions to be taken. An example was given above, which combined with the rest of the text of this Specification enables a person of ordinary skill in the art to set his or her own values, parameters, and corrective actions, depending on the particular situation and demands.

In a different embodiment of the present invention, the data from the Image Analyzer 30 and the thermometer 31 may be provided to an operator, in the form of a table, for example. The operator, in turn, may handle valves (not shown), manually or semiautomatically, of the appropriate bins (36, 38, 40) and feed lines represented by arrows 17, to achieve similar results as aforementioned.

In still another embodiment, regular photographs, including the Polaroid type, may be taken and then analyzed by the Image Analyzer, which may even be installed in a remote location with respect to the kiln.

In still a different embodiment the photographs of the previous embodiment may be analyzed by an operator without the use of an Image Analyzer.

The operation of these embodiments is similar to the first embodiment described above.

The embodiments and the examples demonstrating the operation of the instant invention have been given for illustration purposes only, and should not be construed as restricting the scope or limits of this invention in any way.

What is claimed is:

1. An incinerating kiln device comprising a rotary kiln having a substantially cylindrical shape, an inside wall, an inlet end, an outlet end opposite the inlet end, a bottom side, and a ceiling side, opposite the bottom side, the ceiling side and the bottom side being part of the inside wall, the rotary kiln being adaptable to contain a quantity of molten slag, in a manner that when the kiln rotates, at least a portion of the molten slag temporarily adheres to the inside wall and it is transferred from the bottom side of the kiln to the vicinity of the ceiling side, wherefrom it may fall back to the bottom side, at least partially, in the form of drippings; and detection means at one end of the kiln for determining at least one property of the drippings selected from the group consisting of size of drippings, shape of drippings, aspect ratio of drippings, and number of drippings.

2. A device as defined in claim 1, further comprising means for processing data received from the detection means, thereby correlating said data with at least one slag parameter selected from the group consisting of molten slag-viscosity and molten slag-quantity.

3. A device as defined in claim 2, further comprising means for changing the slag viscosity in a manner to attain a value within desired limits, if the slag viscosity moves outside said desired limits.

4. A device as defined in claim 3, wherein the slag viscosity changing means are operated manually.

5. A device as defined in claim 3, wherein the slag viscosity changing means are operated at least partially automatically.

6. A device as defined in claim 3, wherein the slag viscosity changing means comprise bins for containing additives and for feeding additives to the kiln.

7. A device as defined in claim 2, further comprising means for changing the quantity of the molten slag in a manner to attain a value within desired limits, if the quantity of the molten slag moves outside said desired limits.

8. A device as defined in claim 7, wherein the slag quantity changing means are operated manually.

9. A device as defined in claim 7, wherein the slag quantity changing means are operated at least partially automatically.

10. A device as defined in claim 1, further comprising means for monitoring the temperature of the slag at different positions on the inside wall of the kiln.

11. A device as defined in claim 10, further comprising means for processing data received from the detection means, and the temperature monitoring means, thereby correlating said data with at least one slag parameter selected from the group consisting of molten slag viscosity and molten slag quantity.

12. A device as defined in claim 11, further comprising means for changing the slag viscosity in a manner to attain a value within desired limits, if the slag viscosity moves outside said desired limits.

13. A device as defined in claim 11, further comprising means for changing the quantity of the molten slag in a manner to attain a value within desired limits, if the quantity of molten slag moves outside said desired limits.

14. A method for controlling an incinerating rotary kiln comprising the steps of:

a) feeding waste to the kiln, the kiln having a substantially cylindrical shape, an inside wall, a bottom side, and a ceiling side, opposite the bottom side, the ceiling side and the bottom side being part of the inside wall, the rotary kiln being adaptable to contain a quantity of molten slag, in a manner that when the kiln rotates, at least a portion of the molten slag temporarily adheres to the inside wall and it is transferred from the bottom side of the kiln to the vicinity of the ceiling side, wherefrom it may fall back to the bottom side, at least partially, in the form of drippings; and (b) detecting and determining at least one property of the drippings selected from the group consisting of size of drippings, shape of drippings, aspect ratio of drippings, and number of drippings.

15. A method as defined in claim 14, further comprising the step of processing data received from the detecting step, and correlating said data with at least one slag parameter selected from the group consisting of molten slag viscosity and molten slag quantity.

16. A method as defined in claim 15, further comprising the step of changing the slag viscosity in a manner to attain a value within desired limits, if the slag viscosity moves outside said desired limits.

17. A method as defined in claim 16, wherein the step of changing the slag viscosity is conducted manually.

18. A method as defined in claim 16, wherein the step of changing the slag viscosity is conducted at least partially automatically.

19. A method as defined in claim 15, further comprising the step of changing the slag quantity in a manner to attain a value within desired limits, if the slag quantity moves outside said desired limits.

20. A method as defined in claim 16, wherein the step of changing the slag quantity is conducted manually.

21. A method as defined in claim 16, wherein the step of changing the slag quantity is conducted at least partially automatically.

22. A method as defined in claim 14, further comprising a step of monitoring the temperature of the slag at different positions on the inside wall of the kiln.

23. A method as defined in claim 22, further a step of processing data received from the detecting step, and the temperature monitoring step, thereby correlating said data with at least one slag parameter selected from the group consisting of molten slag viscosity and molten slag quantity.

24. A method as defined in claim 11, further comprising a step of changing the slag viscosity in a manner to attain a value within desired limits, if the slag viscosity moves outside said desired limits.

25. A device as defined in claim 11, further comprising a step of changing the quantity of the molten slag in a manner to attain a value within desired limits, if the quantity of molten slag moves outside said desired limits.

* * * * *